US005588883A

United States Patent [19]

Hattori

[11] Patent Number: 5,588,883

[45] Date of Patent: Dec. 31, 1996

[54] CONNECTOR

[75] Inventor: Kazuhiko Hattori, Yokkaichi, Japan

[73] Assignee: Sumitomo Wiring Systems, Ltd., Japan

[21] Appl. No.: 437,365

[22] Filed: May 9, 1995

[30] Foreign Application Priority Data

Jun. 3, 1994 [JP] Japan ..... 6-145511

[51] Int. Cl.[6] ..... H01R 4/30

[52] U.S. Cl. ..... 439/761; 439/773; 439/838

[58] Field of Search ..... 439/772, 773, 439/761, 838

[56] References Cited

U.S. PATENT DOCUMENTS

| | | | |
|---|---|---|---|
| 1,538,129 | 5/1925 | Masters | 439/761 |
| 1,698,629 | 1/1929 | Haley et al. | 439/773 |
| 1,805,857 | 5/1931 | Trimble et al. | 439/773 |
| 1,859,545 | 5/1932 | Wallenberg et al. . | |
| 1,921,840 | 8/1933 | Recen | 439/773 |
| 2,068,452 | 1/1937 | Hansen | 439/761 |
| 2,196,717 | 4/1940 | Wright | 439/761 |
| 2,314,219 | 3/1943 | Johnson | 439/773 |
| 2,475,415 | 7/1949 | Squires | 439/761 |
| 5,254,020 | 10/1993 | Obligar | 439/761 |
| 5,389,466 | 2/1995 | Inoue et al. | 439/761 |

FOREIGN PATENT DOCUMENTS

| | | | |
|---|---|---|---|
| 2901037 | 7/1979 | Germany | 439/773 |
| 8703228 | 10/1987 | Germany . | |
| 2269272 | 2/1994 | United Kingdom | 439/761 |

*Primary Examiner*—Gary E. Elkins
*Attorney, Agent, or Firm*—Bierman and Muserlian

[57] ABSTRACT

A connecting device having a fastening ring which has an elliptical cross-section and a slot. Projections 18 are on the inner surface of major axis portions of the fastening ring. An outer ring, which also has an elliptical cross-section, larger than the fastening ring and from which a lever projects, is fitted around the outer surface of the fastening ring. When the fastening ring is initially placed on a post, the minor axis portions and the projections on the major axis portions contact the outer surface of the post. When the outer ring is rotated 90° clockwise by means of the lever, the minor axis portions of the outer ring bear against the outside of the major axis portions of the fastening ring, thereby pressing them inwardly. In this way, the fastening ring is tightened and the slot narrows as a consequence. As a result, the fastening ring is securely attached to the post.

10 Claims, 4 Drawing Sheets

CONNECTOR

This Application claims the priority of Japanese Application 6/145511, filed Jun. 3, 1994.

The present Invention relates to a device for connection to an upstanding post. It is particularly designed as a terminal for connection to and release from a post projecting from a battery, especially one for use in an automotive vehicle.

BACKGROUND OF THE INVENTION

Such a battery terminal is disclosed in Japanese Unexamined Utility Model Publication No. 1-95076. One end of a wire connecting portion is connected to the wire and the other end thereof is folded back to form a circular fastening portion. A nut and bolt are mounted where the ends of the wire connecting portions are put together. The wire connecting portion, in a loose state when it has a larger diameter, is fitted around the battery terminal post. Then, the fastening portion is tightened by fastening the nut and bolt to securely couple the connecting portion to the battery terminal post.

However, the prior art battery terminal requires the cumbersome operation of tightening the bolt by means of a wrench while the terminal is being coupled to the terminal post. Particularly in recent years, there has been a tendency to pack a variety of equipment in the engine compartment of the automobile vehicle. This leads to impaired operability because of the lack of room to maneuver the wrench.

SUMMARY OF THE INVENTION

It is an object of the Invention to provide a terminal which can easily be coupled to and released from a post. The Invention will be described for use as an electrical connection to a terminal post on an automobile battery; however, it is understood that it is useful in any device wherein an element is to be physically attached to an upstanding post.

The device comprises a fastening ring, which surrounds the battery post and is of non-circular cross-section, and a non-circular outer ring, which fits outside the fastening ring. The outer ring advantageously is provided with a lever—preferably integral therewith—to facilitate rotation thereof into a tightened position. Rotation of the outer ring into this position, with or without the lever, causes the diameter of the fastening ring to reduce, so that the fastening ring grips the battery post and makes good contact therewith.

Further, there is provided a mechanism for locking the lever in the tightened position. Accordingly, the rotatable ring can be locked in the tightened position. As a result, the loosening of the fastening ring due to rotation of the outer ring resulting from vibrations, etc. can be prevented and consequent connection failures can be avoided.

The fastening ring may carry a wire connecting portion, and an electrically conductive wire is attached to one end thereof. A fixing portion depends from the connecting portion, preferably at a point remote from the wire, and bears against the main body of the battery to prevent the connecting portion from turning when the outer ring is rotated into the tightened position. This permits one-hand operation of the device.

In operation, the outer ring is first placed over the fastening ring, with the major and minor axis portions of the outer ring adjacent the corresponding major and minor axis portions of the fastening ring. The fastening ring, in turn, surrounds the outer surface of the battery post. Upon rotation of the outer ring, the minor axis portions of the outer ring contact the external surfaces of the major axis portions of the fastening ring and the fastening ring is pressed inwardly. Advantageously, the fastening ring is provided with at least one slot; upon exertion of inward pressure by the outer ring, the slot narrows and thereby facilitates gripping of the post by the fastening ring. Thereby, the fastening ring is pressed against the outer surface of the battery post, so that the fastening ring and the wire connecting portion are firmly connected thereto. In a preferred form of the device, at least one projection is formed on the inner surface of the fastening ring, thereby to improve the contact with the battery post.

As described above, according to the Invention, the fastening ring is securely coupled to the battery post by merely rotating the rotatable ring through a small angle. Accordingly, the coupling operation can easily be performed even if there is only limited space due to the presence of other equipment in the engine compartment near the battery.

In the accompanying drawings, constituting a part hereof, and in which like reference characters indicate like parts, FIG. 1 is an exploded perspective view of a battery terminal according to the Invention;

Figure 1:
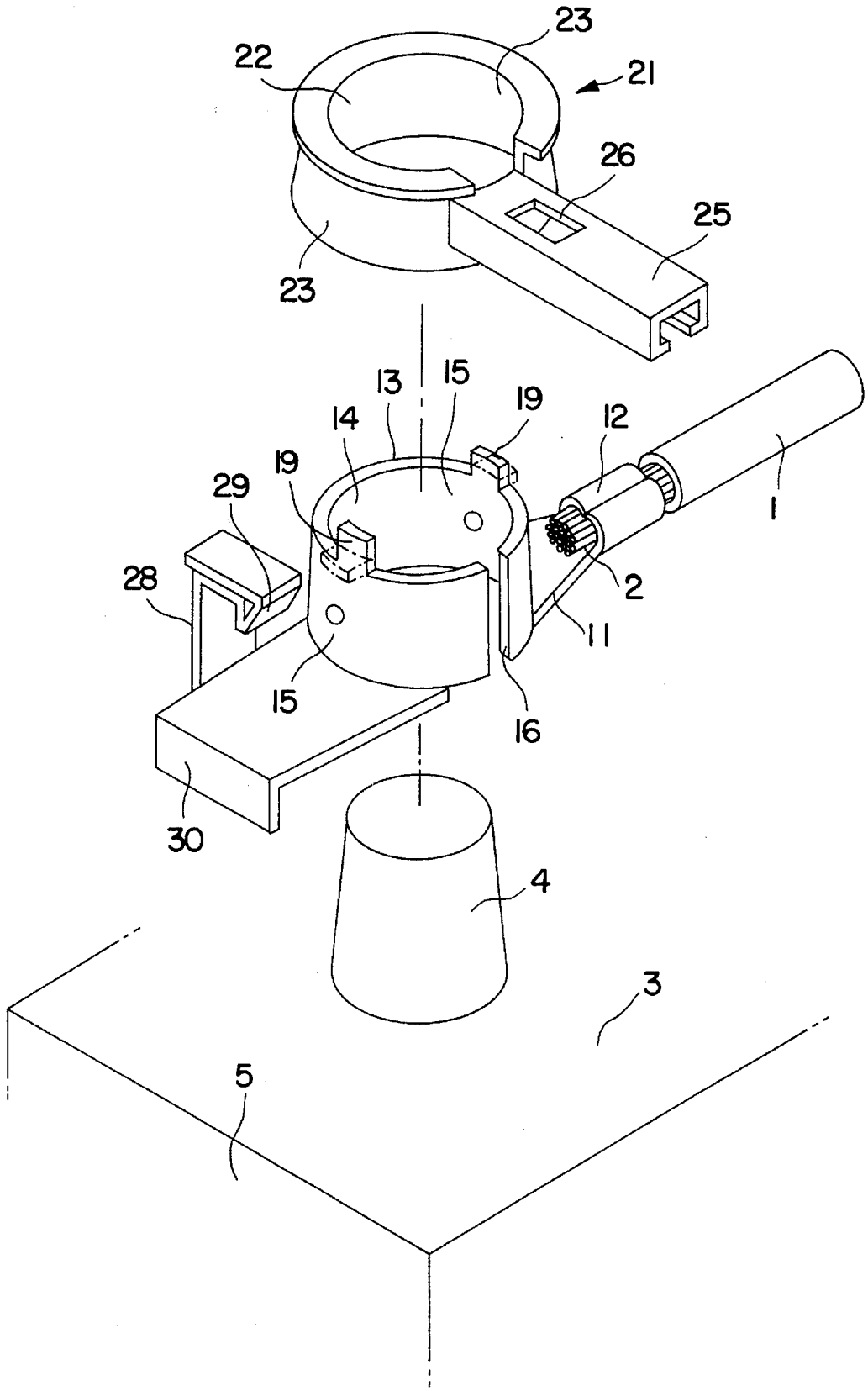

In FIG. 1, wire connecting portion 11, formed of conductive material such as copper alloy, has a long, narrow shape. It is connected, at one longitudinal end, to exposed core 2 of insulated wire 1 by clamping barrel 12.

Figure 2:
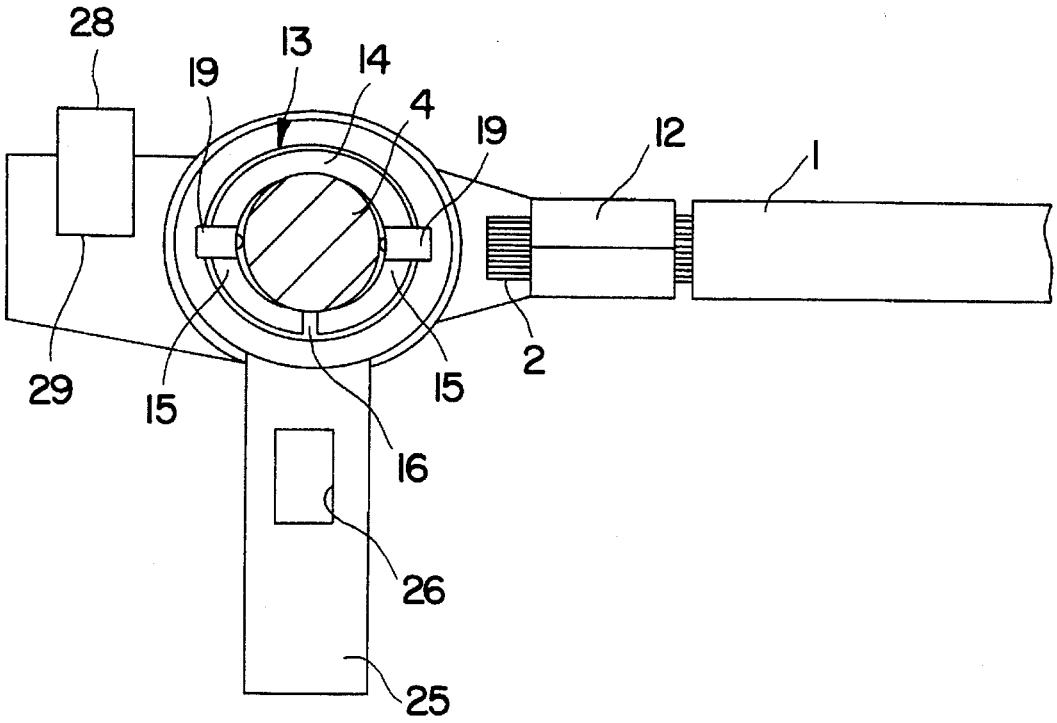
FIG. 2 is a schematic plan view of the device on the battery terminal before fastening.
Figure 3:
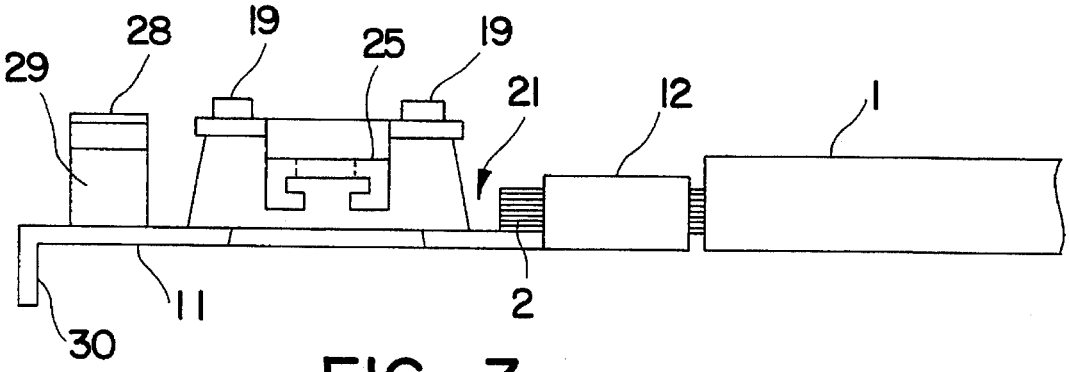
FIG. 3 is a front elevation of the device as shown in FIG. 2.
Figure 6:
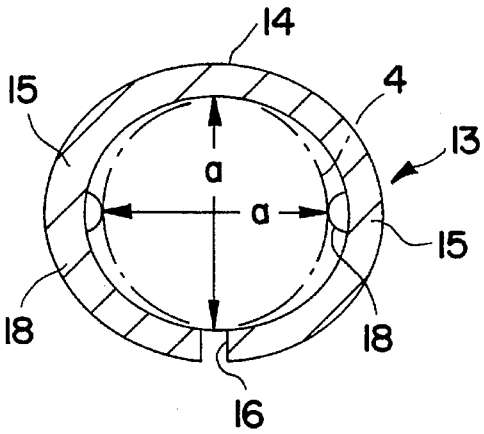
FIG. 6 is a horizontal cross-section of the fastening ring.

In the longitudinal center of the wire connecting portion 11, fastening ring 13 is integrally formed and adapted to fit around battery post 4 projecting from the upper surface of battery main body 3. Battery post 4 is in the form of a cylinder which has a circular horizontal cross-section and tapers toward its upper end. Fastening ring 13 also tapers toward its upper end to conform to the shape of battery post 4. As shown in FIGS. 2 and 6, the horizontal cross-section of fastening ring 13 is an ellipse. Fastening ring 13 has minor axis portions 14 closely fitting the outer surface of battery post 4 and major axis portions 15 which are farther from the center of the ellipse than minor axis portions 14. Minor axis portions 14 are transverse to the longitudinal direction of wire connecting portion 11, whereas the major axis portions 15 are in the longitudinal direction of wire connecting portion 11.

Figure 4:
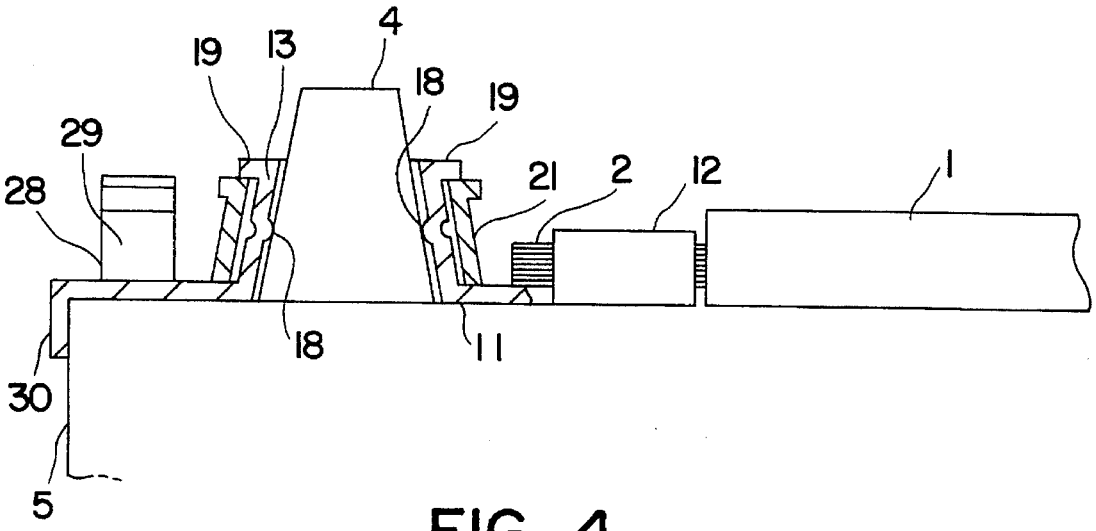
FIG. 4 is a vertical section of the device.

Slot 16 is formed in fastening ring 13 to facilitate compression thereof; preferably, it is located at minor axis portion 14. Slot 16 extends from the upper end to the bottom end of the fastening ring 13. Major axis portions 15 are embossed substantially in the center in the vertical direction, such that projections 18 project inwardly from the inner surface of major axis portions 15 as shown in FIG. 4. As shown in FIG. 6, the distance between projections 18 is equal to the distance between the minor axis portions 14 through the center of the ellipse at the same height. Thus, when fastening ring 13 is fitted around battery post 4, opposed projections 18 contact the outer surface of battery post 4 as do minor axis portions 14.

Outer ring 21 has an elliptical horizontal cross-section, larger than fastening ring 13 at the same height and tapers toward the upper end. It is placed on fastening ring 13 so that minor axis portions 22 and major axis portions 23 thereof are adjacent the corresponding minor axis portions 14 and major axis portions 15 of fastening ring 13. Accordingly, minor axis portions 22 are moved to the outer side of major axis portions 15 by rotation of fastening ring 13 through an angle of approximately 90° whereby slot 16 is narrowed and fastening ring 13 grips battery post 4.

Lever 25 actuates outer ring 21 and projects horizontally outward from the outer surface thereof, preferably at one minor axis portion 22. The opposite lateral edges of lever 25 are folded so as to assure strength and enable an easier grip. Engaging hole 26 is substantially in the longitudinal center of lever 25. At the other longitudinal end of wire connecting portion 11, there is integrally formed locking portion 28 having hook 29 along the rotating path of outer ring 21. Hook 29 is engageable with the engaging hole 26. Specifically, locking portion 28 extends upward from one lateral side (the upper side in FIG. 2) of wire connecting portion 11 to the vicinity of the upper end of fastening ring 13. Locking portion 28 is folded at a right angle to extend horizontally so that it is above the lateral center of wire connecting portion 11. At this point, hook 29 projects downward.

At the upper ends of major axis portions 15 of fastening ring 13, there are formed locking portions 19. As shown in FIG. 1, locking portions 19 initially project upward, but are bent as indicated by phantom lines after mounting outer ring 21 to thereby secure it in position.

As shown in FIG. 4, the leading end of wire connecting portion 11 is bent downward to form fixing plate 30 which fits along the upper edge of one side surface 5 of battery main body 3 to prevent rotation of wire connecting portion 11.

In operation, outer ring 21 is first placed over the outer surface of fastening ring 13 so that major and minor axis portions 23 and 22 are located outside the corresponding major and minor axis portions 15 and 14 of fastening ring 13, and slot 16 thereof is adjacent lever 25. In this position, slot 16 is completely open.

Figure 7A:
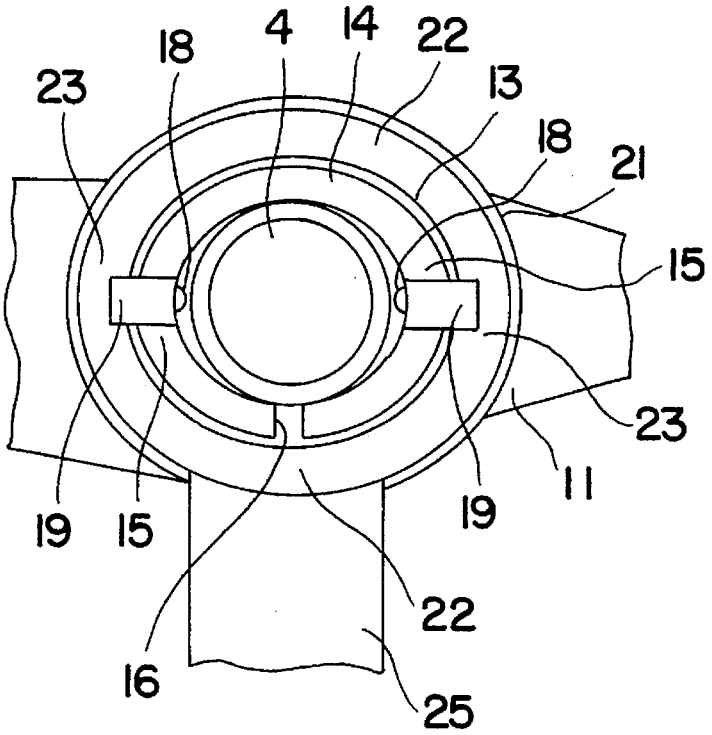
FIG. 7(A) is an enlarged schematic fragmentary plan view of the device before fastening.
Figure 7B:
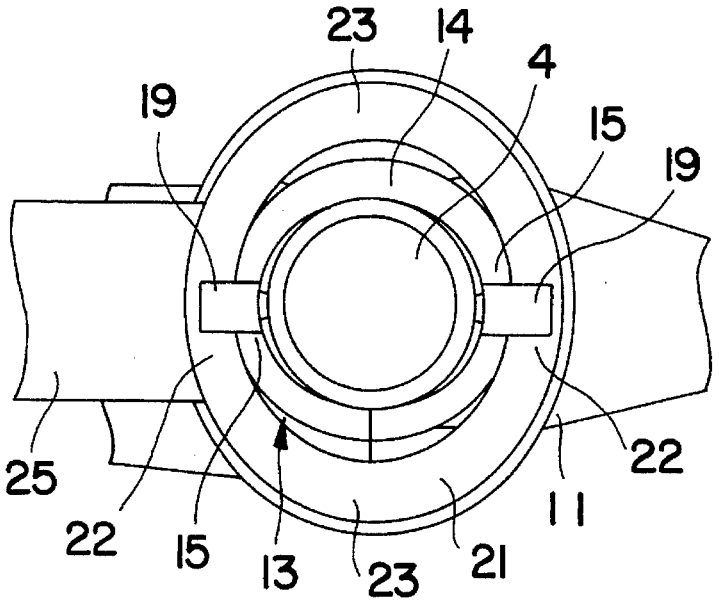
FIG. 7(B) is similar to FIG. 7 (A) with the device in the tightened position.

Fastening ring 13 is placed over the outer surface of battery post 4 while locating fixing plate 30 along side surface 5 of battery main body 3. As shown in FIG. 7(A), minor axis portions 14 and projections 18 formed on the inner surface of major axis portions 15 come into contact with the outer surface of battery post 4.

Subsequently, lever 25 is gripped and rotated 90° clockwise as shown in FIGS. 2 and 7(A). It is unnecessary to hand-hold wire connecting portion 11 since fixing plate 30 engages battery main body 3; this prevents wire connecting portion 11 from rotating together with outer ring 21. At the final stage of rotation, lever 25 is deflected downward and brought under hook 29 of locking portion 28. Upon allowing lever 25 to return to its original undeflected position after it contacts the upwardly extending part of locking portion 28, hook 29 enters hole 26, i.e. lever 25 and outer ring 21 are locked as shown in FIG. 5.

After the foregoing rotation, minor axis portions 22 thereof are outside and adjacent major axis portions 15 of fastening ring 13 and press them inwardly. As a result, fastening ring 13 is bent inwardly about minor axis portion 14 and slot 16 is narrowed. Opposed projections 18 formed on the inner surfaces of major axis portions 15 are tightly pressed against the outer surface of battery post 4. In this way, fastening ring 13 and wire connecting portion 11 are securely coupled to battery post 4 and outer ring 21 is locked by engagement of lever 25 by locking portion 28. This prevents fastening ring 13 from being loosened due to rotation of outer ring 21 resulting from vibrations, etc. during travel of the vehicle.

Figure 5:
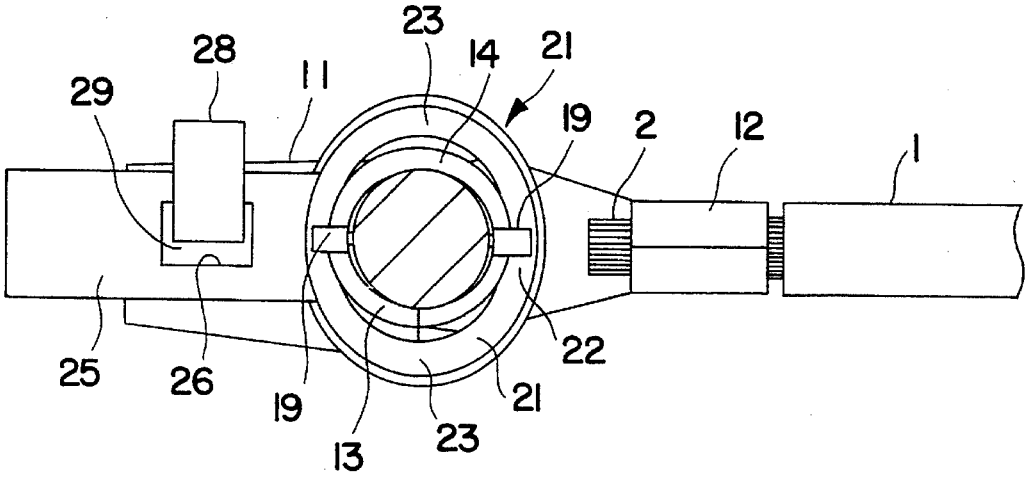
FIG. 5 is a plan view of the device in the tightened position.

To detach the terminal from battery post 4, engaging hole 26 is disengaged from hook 29 by depressing lever 25; lever 25 is then rotated 90° counterclockwise as shown in FIG. 5. Major axis portions 23 and minor axis portions 22 of outer ring 21 are adjacent corresponding major axis portions 15 and minor axis portions 14 of fastening ring 13, thereby allowing the fastening ring 13 to flex outwardly and return to its original diameter. The loosened fastening ring 13 can then be easily pulled upward and detached from battery post 4.

According to this embodiment, the battery terminal can be connected and detached by merely gripping and rotating lever 25. This operation is remarkably simple. Accordingly, even when there is only limited space due to the presence of other equipment around the battery, the connection and detachment can be made easily and speedily. Further, the use of a tool such as a wrench is unnecessary. Particularly, in this embodiment, since lever 25 can be locked, the loosening of fastening ring 13 due to rotation of ring 21 resulting from vibration during travel of a vehicle can be prevented.

The Invention is not limited to the foregoing embodiment; such modifications as would be apparent to the person of ordinary skill may be made without departing from the scope or spirit thereof. For example, (1) although both fastening ring 13 and rotatable ring 21 are shown as being elliptical in cross-section in the embodiment previously described, they may have any other non-circular shape provided that (1) there are larger diameters (major axis portions) and smaller diameters (minor axis portions) and (2) it is possible to move the outer ring so that inward pressure can be exerted on the fastening ring. For example, they may have an oval cross-section.

(2) It is most efficient to form projections 18 on the inner surface of major axis portions 15 of fastening ring 13. However, any desired number of projections may be formed on the inner surface of the fastening ring 13 in any positions where the diameters can be reduced.

(3) Although outer ring 21 is provided with lever 25 in the foregoing embodiment, lever 25 may be omitted and outer ring 21 may be rotated by a wrench or similar tool. Even in this case, the wrench is less likely to interfere with other equipment since it is sufficient to rotate ring 21 through only 90° while holding the wrench horizontally. Operating efficiency is substantially improved compared to conventional bolt fastening.

(4) In the foregoing embodiment, locking portions 19 are bent after rotatable ring 21 is fitted around fastening ring 13 to lock rings 13 and 21 together. The locking mechanism is not limited to this. For example, locking portions 19 can each be bent and notches engageable therewith are formed on the inner surface of outer ring 21 in positions corresponding thereto. When ring 21 is placed on fastening ring 13 and rotated, locking portions 19 engage the corresponding notches. When ring 21 is rotated in the opposite direction, the locking portions 19 are disengaged from the notches, making it possible for outer ring 21 to be released from fastening ring 13. This mechanism obviates the need to bend locking portions 19 after outer ring 21 is fitted around fastening ring 13, thereby enabling easier manufacturing. It is also easier to release the terminal when desired.

These and other modifications of the Invention may be made without departing from the concept thereof; thus, the Invention is to be broadly construed and not to be limited except by the character of the claims appended hereto.

What we claim is:

1. A device for connection to a post comprising a fastening ring having a fastening internal diameter and adapted to surround said post, an outer ring adapted to surround said fastening ring and rotate between an initial position, wherein no inward pressure is exerted on said fastening ring, and a tightened position, wherein inward pressure is exerted on said fastening ring, said inward pressure causing said fastening diameter to decrease and said fastening ring to grip said post, a lever extending radially outwardly, on said outer ring, said lever adapted to rotate said rotatable ring between said initial position and said tightening position, a locking mechanism adapted to retain said lever in said tightened position, said locking mechanism comprising an engaging hole in said lever, a hook mounted on said fastening ring and complementary to said hole when said outer ring is in said tightened position, so that said hook enters said hole in said tightened position.

2. The device of claim 1 wherein at least one projection is on an inner surface of said fastening ring, an innermost point of said projection adapted to contact said post.

3. The device of claim 2 wherein said projection comprises two projections, and a projection diameter extending between said projections is substantially equal to an external diameter of said post.

4. The device of claim 1 wherein said lever and said outer ring are integral.

5. A device for connection to a battery terminal post comprising a fastening ring having a fastening internal diameter and adapted to surround said post, an outer ring adapted to surround said fastening ring and rotate between an initial position, wherein no inward pressure is exerted on said fastening ring, and a tightened position, wherein inward pressure is exerted on said fastening ring, said inward pressure causing said fastening diameter to decrease and said fastening ring to grip said post, an electrically conductive wire attached to said device, a connecting portion on said fastening ring, said wire being connected thereto, said connecting portion being provided with a plate depending therefrom, said plate adapted to bear against a side surface of said battery, thereby to prevent rotation of said fastening ring.

6. The device of claim 5 wherein said plate depends from an edge of said connecting portion remote from said wire.

7. A device for connection to a post comprising a fastening ring having a fastening internal diameter and adapted to surround said post, an outer ring adapted to surround said fastening ring and rotate between an initial position, wherein no inward pressure is exerted on said fastening ring, and a tightened position, wherein inward pressure is exerted on said fastening ring, said inward pressure causing said fastening diameter to decrease and said fastening ring to grip said post, an electrically conductive wire attached to said device, a connecting portion on said fastening ring, said wire being connected thereto, said connecting portion being provided with a plate depending therefrom, said plate adapted to bear against a fixed base, thereby to prevent rotation of said fastening ring about said post.

8. A device for connection to a post comprising a fastening ring having a fastening internal diameter and adapted to surround said post, an outer ring adapted to surround said fastening ring and rotate between an initial position, wherein no inward pressure is exerted on said fastening ring, and a tightened position, wherein inward pressure is exerted on said fastening ring, said inward pressure causing said fastening diameter to decrease and said fastening ring to grip said post, upstanding ears on said fastening ring, said ears adapted to be bent over an adjacent rim of said outer ring, thereby securing said outer ring to said fastening ring.

9. A device for connection to a post comprising a fastening ring having a fastening internal diameter and adapted to surround said post, an outer ring adapted to surround said fastening ring and rotate between an initial position, wherein no inward pressure is exerted on said fastening ring, and a tightened position, wherein inward pressure is exerted on said fastening ring, said inward pressure causing said fastening diameter to decrease and said fastening ring to grip said post, said connecting portion being provided with a plate depending therefrom, said plate adapted to bear against a fixed base, thereby to prevent rotation of said fastening ring about said post.

10. The device of claim 9 wherein said plate depends from an edge of said connecting portion remote from said wire.

* * * * *